United States Patent [19]

Niito

[11] Patent Number: 5,035,198

[45] Date of Patent: Jul. 30, 1991

[54] TONER END DETECTION APPARATUS USING ULTRASONIC SENSOR

[75] Inventor: Yoshiharu Niito, Yokohama, Japan

[73] Assignee: Ricoh Company, Ltd., Tokyo, Japan

[21] Appl. No.: 510,613

[22] Filed: Apr. 18, 1990

[30] Foreign Application Priority Data

Apr. 21, 1989 [JP] Japan ..... 1-103075

[51] Int. Cl.[5] ..... G03G 21/00

[52] U.S. Cl. ..... 118/653; 355/208; 355/246; 118/689; 118/694

[58] Field of Search ..... 118/653, 657, 689, 694; 355/208, 245, 246

[56] References Cited

U.S. PATENT DOCUMENTS 4,647,180 3/1987 Watanabe ..... 355/246
4,916,488 4/1990 Kimura ..... 355/246 X

FOREIGN PATENT DOCUMENTS 0136844 11/1978 Japan ..... 355/246
0130366 8/1983 Japan ..... 355/246
0134669 8/1983 Japan ..... 355/246
0158354 7/1986 Japan ..... 355/208
0281266 12/1986 Japan ..... 355/246

*Primary Examiner*—A. T. Grimley
*Assistant Examiner*—Christopher Horgan
*Attorney, Agent, or Firm*—Cooper & Dunham

[57] ABSTRACT

A toner end detection apparatus comprises a toner tank which accommodates a toner, a toner detection sensor which has a surface exposed within the toner tank and outputs a detection signal and made up of an ultrasonic sensor which oscillates at a predetermined frequency when no toner is adhered on the surface, a setting part for variably setting a set value, a measuring part for measuring an oscillation time of the toner detection sensor in response to the output detection signal of the toner detection sensor, and a discriminating part for discriminating a toner end based on a comparison of the set value which is set by the setting means and the oscillation time which is measured by the measuring means. The toner accommodated within the toner tank is less than a predetermined quantity when the toner end is detected.

10 Claims, 4 Drawing Sheets

TONER END DETECTION APPARATUS USING ULTRASONIC SENSOR

BACKGROUND OF THE INVENTION

The present invention generally relates to toner end detection apparatuses, and more particularly to a toner end detection apparatus of an image forming apparatus such as a laser printer, a copying machine and a facsimile machine which use a developing agent.

Generally, an image forming apparatus such as a laser printer which uses a developing agent (toner) is provided with a toner end detection apparatus. The toner end detection apparatus detects a toner end when a quantity of toner remaining within a toner tank becomes less than a predetermined value.

Conventionally, the toner end detection apparatus has an ultrasonic toner detection sensor which oscillates at a fixed oscillation frequency when the toner is adhered on a surface of the ultrasonic toner detection sensor and outputs a signal having a fixed level when a predetermined quantity of toner remains within the toner tank. The output signal of the ultrasonic toner detection sensor is supplied to an input port of a microcomputer, and the microcomputer detects the toner end by discriminating whether or not the ultrasonic toner end detection sensor is oscillating.

However, inside a developing unit, an agitator rotates at a predetermined period so as to uniformly distribute the toner. In addition, in order to prevent the toner from adhering on the surface of the ultrasonic toner detection sensor, a toner cleaning member is rotated in synchronism with the agitator.

For this reason, even when a sufficient quantity of toner exists within the developing unit, the ultrasonic toner detection sensor may erroneously detect the toner end because the no toner is adhered on the surface of the ultrasonic toner detection sensor and the ultrasonic toner detection sensor oscillates temporarily immediately after the agitator and the toner cleaning member pass the surface of the ultrasonic toner detection sensor.

SUMMARY OF THE INVENTION

Accordingly, it is a general object of the present invention to provide a novel and useful toner end detection apparatus in which the problems described above are eliminated.

Another and more specific object of the present invention is to provide a toner end detection apparatus comprising a toner tank which accommodates a toner, a toner detection sensor which has a surface exposed within the toner tank and outputs a detection signal and made up of an ultrasonic sensor which oscillates at a predetermined frequency when no toner is adhered on the surface, setting means for variably setting a set value, measuring means for measuring an oscillation time of the toner detection sensor in response to the output detection signal of the toner detection sensor, and discriminating means for discriminating a toner end based on a comparison of the set value which is set by the setting means and the oscillation time which is measured by the measuring means. The toner accommodated within the toner tank is less than a predetermined quantity when the toner end is detected. According to the toner end detection apparatus of the present invention, it is possible to detect the toner end with a high accuracy. In addition, it is possible to maintain the highly accurate toner end detection by variably setting the set value depending on an inconsistency of the quantity of toner remaining within the toner tank when the toner end detection is made.

Other objects and further features of the present invention will be apparent from the following detailed description when read in conjunction with the accompanying drawings.

DESCRIPTION OF THE PREFERRED EMBODIMENTS

Figure 1:
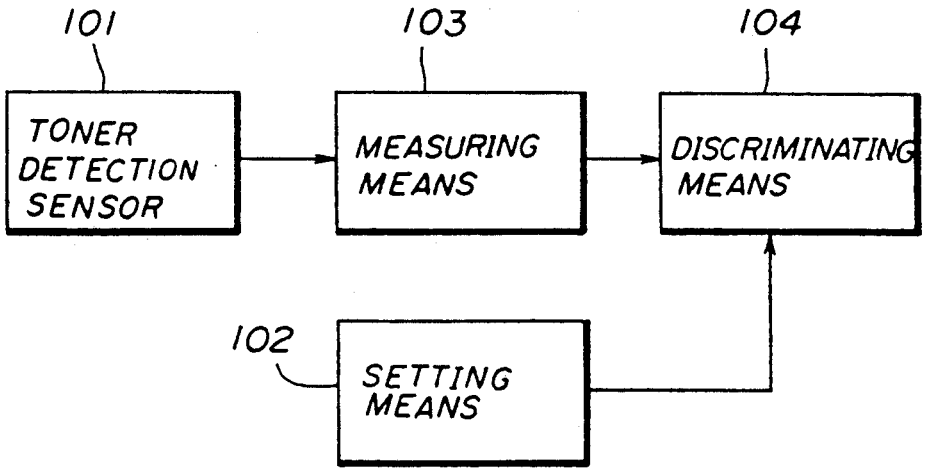
FIG. 1 is a system block diagram generally showing a toner end detection apparatus according to the present invention for explaining an operating principle thereof.

First, a description will be given of an operating principle of a toner end detection apparatus according to the present invention, by referring to FIG. 1. In FIG. 1, the toner end detection apparatus generally comprises a toner detection sensor 101, a setting means 102, a measuring means 103 and a discriminating means 104. The toner detection sensor 101 is of an ultrasonic type. The setting means 102 variably sets a set value in advance. The measuring means 103 measures an oscillation time of the toner detection sensor 101 within a predetermined time. The discriminating means 104 discriminates a toner end by comparing the set value set by the setting means 102 and the measured value measured by the measuring means 103.

When a quantity of remaining toner within a developing unit becomes less than a predetermined quantity, the oscillation time of the toner detection sensor 101 increases as the quantity of remaining toner decreases. The measuring means 103 measures the oscillation time of the toner detection sensor 101 within one period of the rotation of an agitator, and the discriminating means 104 compares set value set by the setting means 102 and the measured value measured by the measuring means 103. The discriminating means 104 detects the toner end when the measured value is greater than or equal to the set value.

Accordingly, the toner end can be detected with a high accuracy. In addition, by varying the set value depending on an inconsistency in the quantity of remaining toner at the time when the toner end is detected, it is possible to maintain the high accuracy of the toner end detection.

Figure 2:
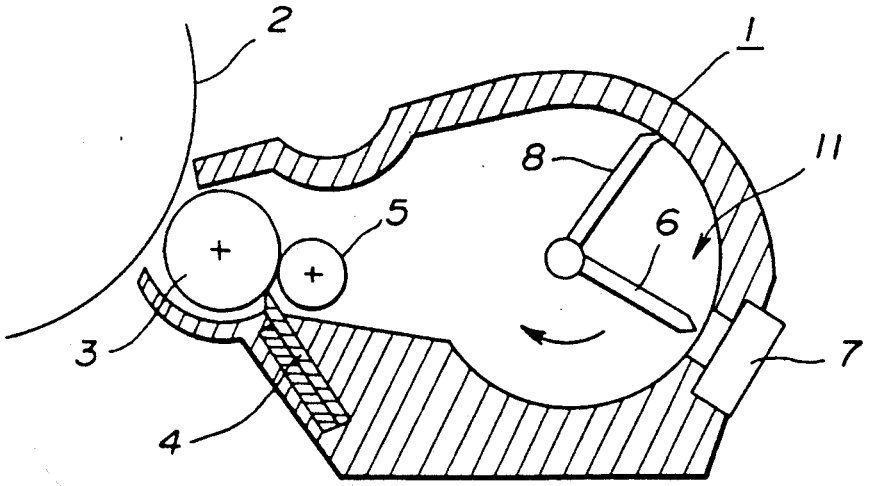
FIG. 2 is a cross sectional view generally showing a developing unit of an image forming apparatus which is provided with the toner end detection apparatus according to the present invention.

Next, a description will be given of an embodiment of the toner end detection apparatus according to the present invention. FIG. 2 generally shows a developing unit of an image forming apparatus which is provided with the toner end detection apparatus according to the present invention.

In FIG. 2, a developing unit 1 comprises a developing roller 3 which adheres the toner on a surface of a photosensitive body 2, a blade 4 which restricts the thickness of the toner which adheres on the surface of the developing roller 3, and a supply roller 5 which supplies the toner to the developing roller 3.

An agitator 6 for uniformly distributing the toner, an ultrasonic toner detection sensor 7, and a toner cleaning member 8 are also provided in the developing unit 1. The cleaning member 8 prevents the toner from becoming permanently fixed on the surface of the toner detection sensor 7 exposed within a toner tank 11 which accommodates the toner. The agitator 6 and the toner cleaning member 8 rotate in synchronism with each other within the toner tank 11.

Figure 3:
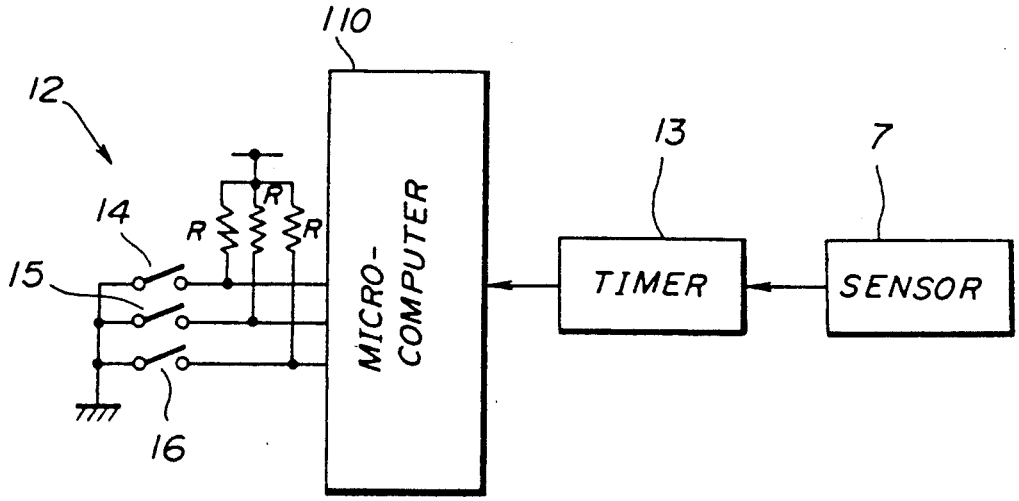
FIGS. 3 and 4 respectively are system block diagrams showing first and second embodiments of the toner end detection apparatus according to the present invention.

FIG. 3 shows an embodiment of the toner end detection apparatus. The toner end detection apparatus shown in FIG. 3 comprises a microcomputer 110, a setting part 12, a timer 13 and the like which are connected as shown. The microcomputer 110 includes a central processing unit (CPU), a read only memory (ROM), a random access memory (RAM), input/output ports and the like. The microcomputer 110 includes the discriminating means 104 and controls the entire image forming apparatus such as a sequential control of the image forming process. The setting part 12 sets the set value which is used for the toner end detection. The timer 13 receives a detection signal from the toner detection sensor 7 and measures the oscillation time of the toner detection sensor 7.

The setting part 12 comprises three switches 14 through 16 and three resistors R. The set state (set value) of the switches 14 through 16 are supplied to the input port of the microcomputer 11.

Figure 4:
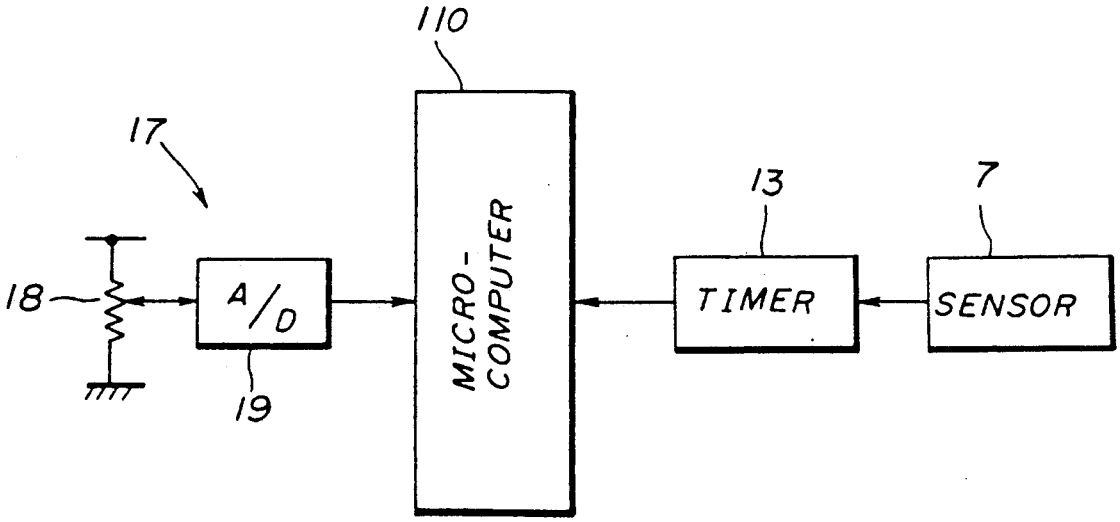

FIG. 4 shows another embodiment of the toner end detection according to the present invention. In FIG. 4, those parts which are basically the same as those corresponding parts in FIG. 3 are designated by the same reference numerals, and a description thereof will be omitted. The toner end detection apparatus shown in FIG. 4 comprises a setting part 17 which is made up of a variable resistor 18 and an analog-to-digital (A/D) converter 19. The A/D converter 19 converts a set voltage which is obtained from the variable resistor 18 into a digital set value, and this digital set value is supplied to the input port of the microcomputer 110.

Next, a description will be given of an operation of the embodiments, by referring to FIGS. 5 and 6.

Figures 5A, 5B, 5C:
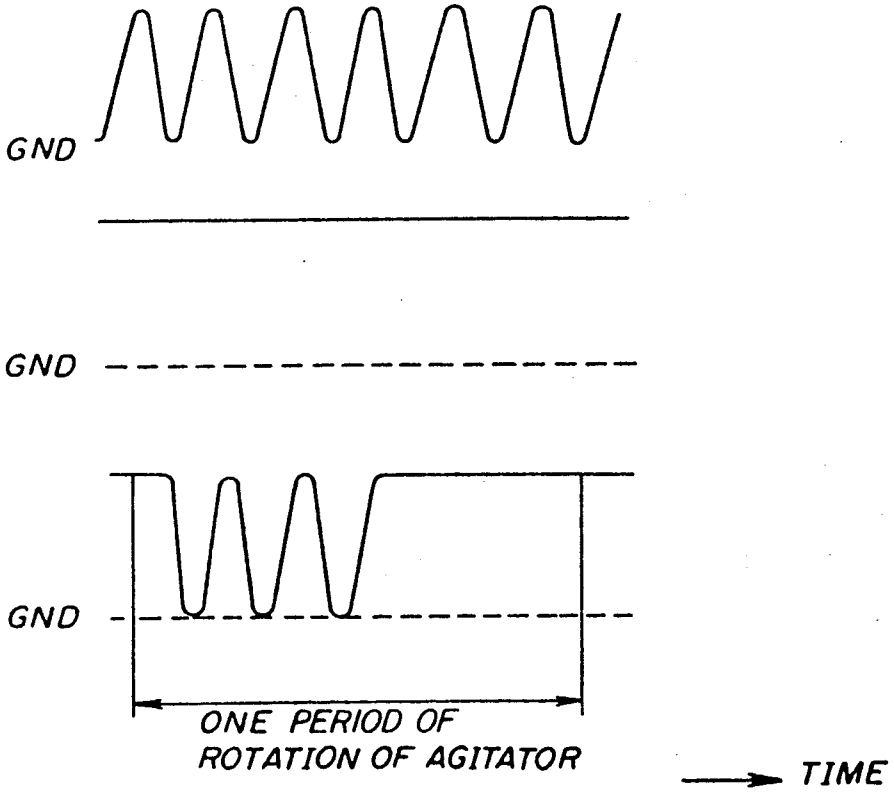
FIGS. 5(A) through 5(C) are time charts for explaining an output of a toner detection sensor.

When no toner is adhered on the surface of the toner detection sensor 7, the toner detection sensor 7 oscillates at a fixed oscillation frequency as shown in FIG. 5(A), and an output signal of the toner detection sensor 7 has a fixed level as shown in FIG. 5(B) when a predetermined quantity of toner remains within the developing unit 1. However, although temporarily, no toner is adhered on the surface of the toner detection sensor 7 immediately after the agitator 6 or the toner cleaning member 8 passes the surface of the toner detection sensor 7. For this reason, the toner detection sensor 7 oscillates for a short time as shown in FIG. 5(C). In FIGS. 5(A) through 5(C), GND denotes a ground potential (voltage).

Figure 6:
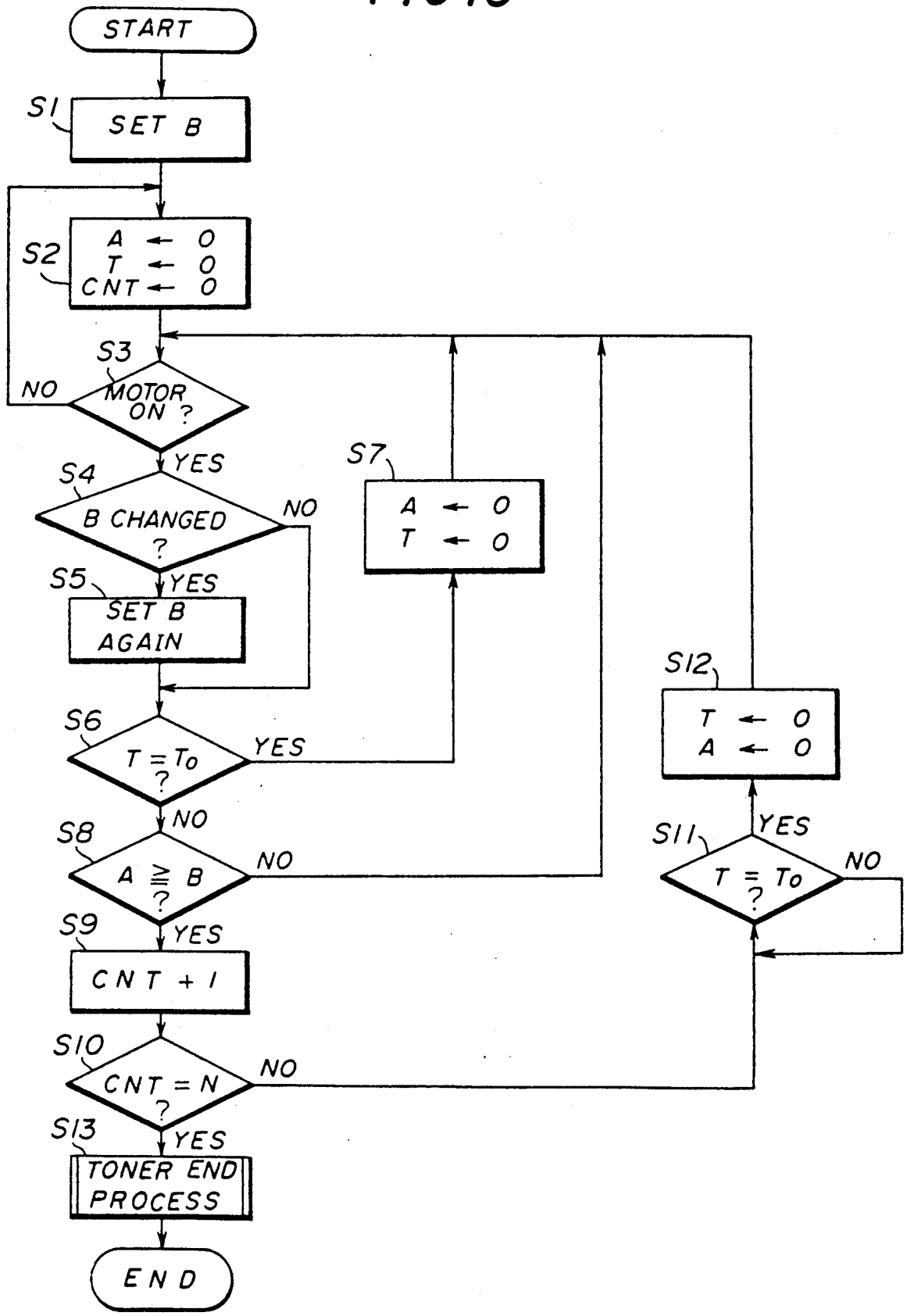
FIG. 6 is a flow chart for explaining a toner end detection process of a microcomputer shown in FIGS. 3 and 4.

FIG. 6 shows a toner end detection process of the microcomputer 11 shown in FIGS. 3 and 4. A step S1 enters as a set value B the state of the switches 14 through 16 of the setting part 12 shown in FIG. 3 or the set digital value output from the A/D converter 19 of the setting part 17 shown in FIG. 4. A step S2 clears to "0" a set value A of the timer 13, a timer count T which is used to check whether or not the agitator 6 has made on revolution, and a count CNT of an internal counter which counts a number of times $A \geqq B$ is satisfied.

A step S3 discriminates whether or not the agitator 6 is rotating by detecting whether or not a motor (not shown) which drives the agitator 6 is rotating. When the discrimination result in the step S3 is NO, the process returns to the clear process S2. On the other hand, when the discrimination result in the step S3 is YES, a step S4 discriminates whether or not the set value from the setting part 12 or 14 is changed. When the discrimination result in the step S4 is YES, a step S5 sets the set value B again.

After the step S5 or when the discrimination result in the step S4 is NO, a step S6 discriminates whether or not the timer count T is equal to one period T0 of the rotation of the agitator 6. When $T=T0$ and the discrimination result in the step S6 is YES, a step S7 clears the measured value A and the timer count T to "0" and the process returns to the step S3.

On the other hand, when the agitator 6 has not made one revolution and the discrimination result in the step S6 is NO, a step S8 reads the measured value A which is measured by the timer 13 during the oscillation period of the toner detection sensor 7 and discriminates whether or not the measured value A is greater than or equal to the set value B. The process returns to the step S3 when the discrimination result in the step S8 is NO.

When $A \geqq B$ and the discrimination result in the step S8 is YES, a step S9 increments the count CNT by one and a step S10 discriminates whether or not the count CNT is equal to N, where N is an integer. In other words, the step S10 discriminates whether or not the relation $A \geqq B$ is satisfied N times. When the discrimination result in the step S10 is NO, a step S11 discriminates whether or not $T=T0$. In addition, when the discrimination result in the step S11 becomes YES, a step S12 clears the timer count T and the measured value A to "0" and the process returns to the step S3.

But when the discrimination result in the step S10 is YES, a step S13 detects the toner end and carries out a known toner end process. The process ends after the step S13.

According to this embodiment, the measured value A is obtained by measuring the oscillation time of the toner detection sensor 7 during one period of the rotation of the agitator 6, and this measured value A is compared with the set value B. The toner end is detected when $A \geqq B$. For this reason, the toner end can be detected with a high accuracy, and it is possible to maintain the highly accurate toner end detection by variably setting the set value B depending on the inconsistency of the quantity of remaining toner at the time when the toner end detection is made.

In addition, because the toner end is first detected when the relation $A \geqq B$ is satisfied N consecutive times, it is possible to make the toner end detection with a high accuracy.

Of course, the toner end detection apparatus according to the present invention is applicable to any type of image forming apparatus which uses a developing agent, such as a laser printer, a copying machine and a facsimile machine.

Further, the present invention is not limited to these embodiments, but various variations and modifications may be made without departing from the scope of the present invention.

What is claimed is:

1. A toner end detection apparatus comprising:

a toner tank which accommodates a toner;

an agitator which is rotatably provided within said toner tank for uniformly distributing the toner within said toner tank;

a motor for rotating said agitator;

detecting means for detecting a rotational state of said motor and for outputting a detection signal dependent on the detected rotational state;

a toner detection sensor which has a surface exposed within said toner tank and outputs a detection signal, said toner detection sensor being made up of an ultrasonic sensor which oscillates at a predetermined frequency when no toner is adhered on said surface;

setting means for variably setting a set value;

measuring means for measuring an oscillation time of said toner detection sensor in response to the output detection signal of said toner detection sensor;

discriminating means for discriminating a toner end based on a comparison of the set value which is set by said setting means and the oscillation time which is measured by said measuring means, said toner accommodated within said toner tank being less than a predetermined quantity when the toner end is detected; and clearing means responsive to the detection signal output from said detecting means for clearing the set value set by said setting means when activated, said clearing means being activated immediately when said detecting means detects no rotation of said motor and activated at least after one revolution of said agitator when said detecting means detects rotation of said motor, said discriminating means detecting the toner end when the measured oscillation time is greater than or equal to the set value N consecutive times, where N is an integer.

2. The toner end detection apparatus as claimed in claim 1 wherein said oscillation time occurs immediately after said agitator passes the surface of said toner detection sensor.

3. The toner end detection apparatus as claimed in claim 2 wherein said measuring means measures the oscillation time within one period of rotation of said agitator.

4. The toner end detection apparatus as claimed in claim 1 which further comprises a cleaning member which is rotatably provided within said toner tank for preventing the toner within said toner tank from becoming permanently fixed on the surface of said toner detection sensor, said oscillation time occurring immediately after said cleaning member passes the surface of said toner detection sensor.

5. The toner end detection apparatus as claimed in claim 1 which further comprises an agitator which is rotatably provided within said toner tank for uniformly distributing the toner within said toner tank, and a cleaning member which is rotatably provided within said toner tank for preventing the toner within said toner tank from becoming permanently fixed on the surface of said toner detection sensor, said oscillation time occurring immediately after either one of said agitator and said cleaning member passes the surface of said toner detection sensor.

6. The toner end detection apparatus as claimed in claim 1 wherein said setting means comprises a plurality of switches, said measuring means comprises a timer which is responsive to the output detection signal of said toner detection sensor, and said discriminating means comprises a microcomputer which detects the toner end in response to outputs of said switches and said timer.

7. The toner end detection apparatus as claimed in claim 1 wherein said setting means comprises a variable resistor for outputting a set voltage and an analog-to-digital converter for outputting the set value in response to the set voltage, said measuring means comprises a timer which is responsive to the output detection signal of said toner detection sensor, and said discriminating means comprises a microcomputer which detects the toner end in response to outputs of said analog-to-digital converter and said timer.

8. The toner end detection apparatus as claimed in claim 1 wherein said setting means variably sets the set value depending on an inconsistency of a quantity of toner remaining within said toner tank when said discriminating means makes the toner end detection.

9. The toner end detection apparatus as claimed in claim 1 wherein said discriminating means includes a timer for counting and keeping a count of a number of revolutions of said agitator, said clearing means being activated after a predetermined number of revolutions of said agitator when said detecting means detects rotation of said motor and clearing the count of said timer.

10. Apparatus comprising:

a toner tank for storing toner;

an agitator rotatably mounted in the toner tank to stir toner stored therein and a motor rotating the agitator;

a motor rotation sensor coupled to the motor to provide a rotation output signals each indicative of a rotation state of the motor;

an ultrasonic sensor having a surface mounted in the toner tank to oscillate at a predetermined frequency in the absence of toner thereon and to provide a corresponding oscillation signal;

a reference circuit providing a set value settable by an operator;

a timer circuit coupled with the motor rotation sensor to receive the rotation output signals therefrom and with the ultrasonic sensor to receive the oscillation signal therefrom and to provide a respective timer value related to the duration of the oscillation signal associated with each rotation output signal;

a comparator circuit coupled with the motor rotation sensor, with the timer circuit and with the reference circuit to receive the rotation output signals, the set value and the timer value therefrom and responsive to each rotation output signal to compare the timer value associated therewith with the set value and to provide a first comparator output signal when the timer value exceeds the set value; and a toner consumption indicating circuit coupled with the comparator circuit and responsive to the occurrence of a first comparator output signal in each a selected number of consecutive comparisons to provide a signal indicative of the consumption of toner from the toner tank.

* * * * *